US008369187B2

(12) United States Patent
Artola Godoy

(10) Patent No.: US 8,369,187 B2
(45) Date of Patent: Feb. 5, 2013

(54) WARNING DEVICE

(75) Inventor: Manuel Artola Godoy, Barcelona (ES)

(73) Assignee: Cadama Technology, S.L., Barcelona (ES)

( * ) Notice: Subject to any disclaimer, the term of this patent is extended or adjusted under 35 U.S.C. 154(b) by 249 days.

(21) Appl. No.: 12/742,384

(22) PCT Filed: Oct. 30, 2008

(86) PCT No.: PCT/EP2008/064718

§ 371 (c)(1),
(2), (4) Date: May 11, 2010

(87) PCT Pub. No.: WO2009/068406

PCT Pub. Date: Jun. 4, 2009

(65) Prior Publication Data

US 2010/0259379 A1 Oct. 14, 2010

(30) Foreign Application Priority Data

Nov. 30, 2007 (ES) ..... 200703180

(51) Int. Cl.
*G04F 8/00* (2006.01)
*G04F 1/00* (2006.01)
*G08B 21/00* (2006.01)

(52) U.S. Cl. ..... 368/109; 368/89; 368/107; 368/108; 340/540

(58) Field of Classification Search ..... 368/107–109, 368/89

See application file for complete search history.

(56) References Cited

U.S. PATENT DOCUMENTS

| | | | | |
|---|---|---|---|---|
| 4,419,016 | A * | 12/1983 | Zoltan | 368/10 |
| 4,731,603 | A * | 3/1988 | McRae et al. | 340/407.1 |
| 5,282,181 | A * | 1/1994 | Entner et al. | 368/73 |
| 6,324,123 | B1 * | 11/2001 | Durso | 368/10 |
| 7,084,775 | B1 * | 8/2006 | Smith | 340/601 |
| 7,719,927 | B1 * | 5/2010 | Robinson et al. | 368/10 |
| 7,885,146 | B2 * | 2/2011 | Parkinson et al. | 368/109 |
| 2005/0117455 | A1 | 6/2005 | Valerio | |
| 2006/0109750 | A1 | 5/2006 | McCracken et al. | |
| 2007/0015129 | A1 | 1/2007 | Connell | |
| 2007/0064541 | A1 | 3/2007 | Kagan | |
| 2007/0273506 | A1 | 11/2007 | Butler | |

FOREIGN PATENT DOCUMENTS

| | | | |
|---|---|---|---|
| EP | 0 182 249 | A2 | 5/1986 |
| FR | 2 709 417 | A1 | 3/1995 |
| GB | 2 324 611 | A | 10/1998 |
| WO | 2004/095148 | A2 | 11/2004 |
| WO | 2007/138125 | A1 | 12/2007 |

OTHER PUBLICATIONS

Spanish Search Report, dated Jul. 21, 2010.

International Preliminary Report on Patentability for PCT/EP2008/064718, dated Jun. 1, 2010.

European Patent Office Action for Application No. 08 854 026.5, dated Feb. 28, 2012.

* cited by examiner

*Primary Examiner* — Brian Zimmerman
*Assistant Examiner* — Omeed Alizada
(74) *Attorney, Agent, or Firm* — Sughrue Mion, PLLC

(57) ABSTRACT

The invention relates to a warning device, provided with an electronic warning unit, capable of generating warning signals at pre-programmed constant time intervals, embedded inside a body formed by a single piece of mouldable synthetic material, such as a plastic or silicone, which is provided with starting means for staring the warning device, which means can be actuated by means of the application of a pressure on a part of the outer surface of the mentioned body.

15 Claims, 2 Drawing Sheets

WARNING DEVICE

TECHNICAL FIELD OF THE INVENTION

The present invention relates to a warning device, provided with an electronic warning unit powered by a battery and capable of generating warning signals at preprogrammed constant time intervals.

The warning device in question has a preferred application as a warning and/or reminder device for taking medicaments.

BACKGROUND OF THE INVENTION

In order for a medicament to have its highest efficacy, it is essential to scrupulously follow the indications of the doctor for its correct administration, both in the quantification of the doses and in the number thereof and at the time intervals therebetween.

It frequently occurs that the longer the treatment time elapsed, the likelier it is for the patient to forget or make a mistake in any of the doses. Therefore, the use of reminder and/or warning devices for the times at which the corresponding doses of the treatment must be taken is convenient, at least in prolonged treatments. Normally when several of these days have passed, the treatment is occasionally interrupted, either due to carelessness or forgetfulness or due to believing that all the prescribed doses are not necessary. It is also true that on occasions, the correct dose is not taken at the prescribed intervals.

Therefore the use of a device which facilitates the taking of medication during the indicated period, warning at the specific intervals at which the medication must be taken, is thought to be necessary.

To solve or alleviate this problem, there are a number of embodiments of clocks, timers and similar devices the greatest exponent of best efficiency-quality/price relationship of which could be that described in patent application WO 2004/095148, which refers to a timer including electronic means programmed in the factory for counting preprogrammed time periods a number of also predetermined times according to the program required for the administration of a specific product, as well as warning means for providing an indication of the end of the time period, for the purpose of informing the user so that he or she takes a certain action. In this embodiment, the fact that the electronic means can be "waterproofed", if desired, by wrapping them in nylon is mentioned. The fact that the timer can be a single-use timer is also mentioned.

However, such waterproofing is at the least complicated and not very effective and the construction of the timer is not even as inexpensive as to allow it to be discarded after a single use. Furthermore, in the embodiment object of patent WO 2004/095148, there is no assurance that the timer cannot be reprogrammed again, or simply reused, by the user, which involves an enormous risk of malfunction, for example, due to an unexpected failure of the battery during a second use of the timer or due to a bad programming, especially if it is taken into account that any manipulation of the timer without a suitable knowledge of its operation will undoubtedly give rise to a bad use thereof, particularly if the user is, as occurs in most of the cases, a minor, an elderly patient or a layman in the art.

An objective of the present invention is, therefore, to disclose a warning device which actually is a single-use device and which at the same time is completely waterproof, impossible to reprogram by the user and easy and comfortable to use, without therefore renouncing to the reduction of the manufacturing cost of said device.

DISCLOSURE OF THE INVENTION

The warning device object of the present invention eliminates all the previously mentioned drawbacks and problems of the known embodiments and is essentially characterized in that, being provided with an electronic warning unit, powered by a battery and capable of generating warning signals at preprogrammed constant time intervals, said electronic warning unit is embedded inside a body formed by a single piece of a mouldable synthetic material, such as a plastic or a silicone; in that the electronic warning unit is provided with starting means for starting the warning device, which means can be actuated by means of the application of a pressure on a part of the outer surface of the body; and in that the total number of signals is also preprogrammed, the electronic warning unit further being suitable so that the last warning signal of the preprogrammed signals is clearly differentiated in intrinsic constitution, in intensity and/or in duration from the rest of the preceding signals.

The warning device is therefore not provided with attachable parts or with lids for closing receptacles intended to house the electronic components, which significantly reduces the manufacturing cost and both the waterproofing of the electronic components and their inaccessibility is ensured.

According to another feature of the invention, the last warning signal lasts continuously until the battery is completely used up. This last warning coincides with the total number of possible doses of the drug to which the device is associated.

According to a particularly interesting embodiment, the electronic warning unit comprises a printed-circuit board and originally there is no electrical communication between the battery and said printed-circuit board, the mentioned electronic warning unit being provided with starting means, which can be actuated by means of the application of a pressure on the part of the outer surface of the body, suitable for irreversibly establishing electrical communication between the mentioned battery and the printed-circuit board.

According to another feature of the invention, the electronic warning unit comprises a rigid base-support, also embedded inside the one-piece body made of mouldable synthetic material, provided with at least a first cavity intended to house a printed-circuit board, with a second cavity intended to house the battery and with a third cavity intended to house a vibrator device.

According to another feature of the invention, the one-piece body has a ring-shaped configuration.

According to another feature of the invention, the one-piece body is provided on its outer surface with indelible optical and/or tactile indications, intended to inform the user of the preprogrammed time between every two consecutive warning signals and/or of the total number of preprogrammed signals.

BRIEF DESCRIPTION OF THE DRAWINGS

The attached drawings show, by way of a non-limiting example, an embodiment of the warning device object of the invention. Specifically.

DETAILED DESCRIPTION OF THE DRAWINGS

Figure 1:
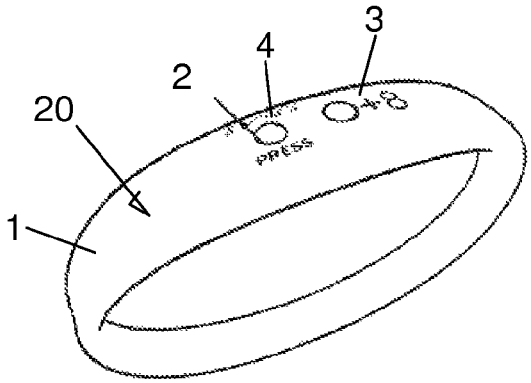
FIGS. 1 and 2 are respective perspective and side views, respectively, of a warning device according to the invention.
Figure 2:
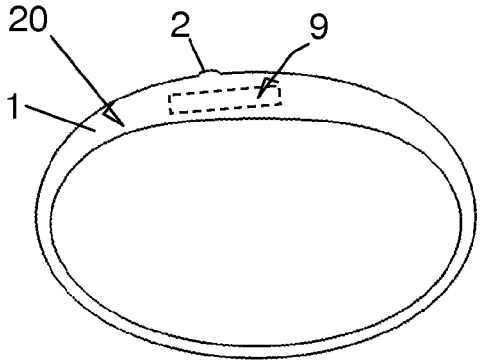
Figure 3:
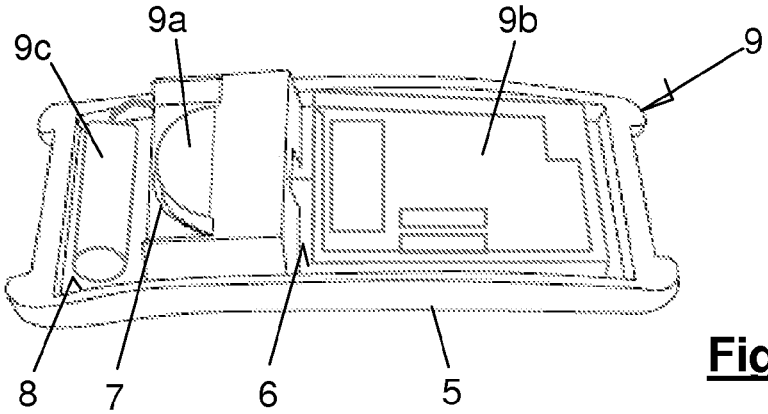
FIG. 3 also shows a perspective view of an embodiment of the electronic warning unit.

In said drawings it can be observed that the warning device 20 shown therein has a ring-shaped configuration and is particularly suitable for the user to use it as a bracelet or an anklet, for example. To that end, the warning device 20 is preferably manufactured in an elastic, flexible and ring-shaped one-piece body 1 made of silicone. This material from which the body 1 is formed provides it with features of interest, as it is also odorless, non-toxic and antiallergenic.

On the outer surface of the one-piece body 1 there is observed a slightly projecting part 2, providing the body 1 with a smooth projection below which the starting means 17 (see FIGS. 4 to 6) for starting the warning device 20 are arranged, which means can be actuated by means of the application of a pressure on the projection.

Furthermore, also in the outer part of the one-piece body 1, there are indelible optical indications 3 in the form of symbols, in low relief or screen-printed for example, intended to inform the doctor or the user of the preprogrammed time between every two consecutive warning signals, as well as relief indications 4 in Braille language. As regards the indelible indications 3, they can be made in negative, for example, in the same mould used in the shaping of the one-piece body 1.

Figure 4:
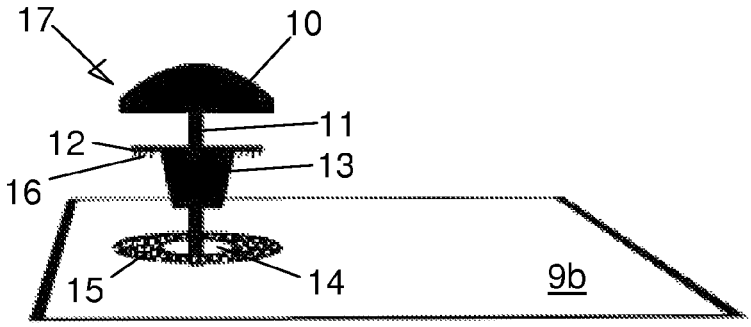
FIGS. 4, 5 and 6 are respective elevational, schematic and positionally sequential views of a preferred embodiment of an actuating button applicable in the warning device of the invention.
Figure 5:
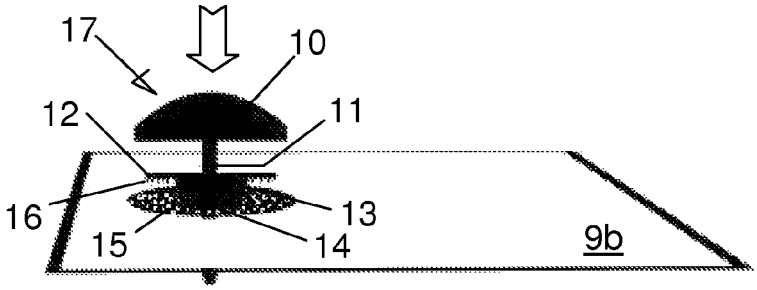
Figure 6:
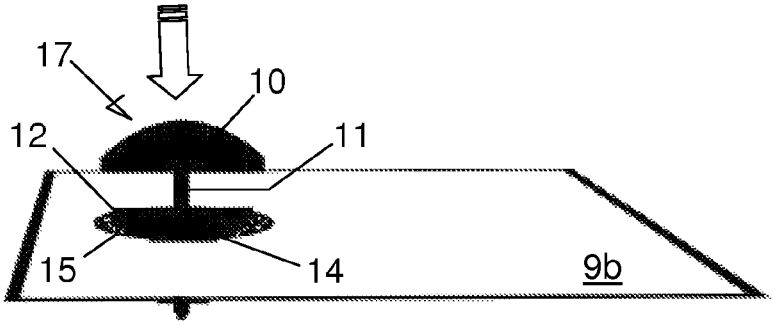

The warning device 20 comprises an electronic warning unit 9, essentially formed by a printed-circuit board 9*b*, schematically shown in FIGS. 4, 5 and 6, embedded inside the one-piece body 1 (inaccessible from the outside) and provided with starting means 17 for starting the warning device 20, which means can be actuated by means of the application of a pressure on the projection of the part 2 of the outer surface of the one-piece body 1. Said starting means 17 are arranged immediately below the projection and comprise a button 10, a rod 11, a disc 12 and a centring portion 13 which are integrally joined, the centring portion 13 being suitable for being introduced in a hole 14, made in the board 9*b* and provided with a an adherent and/or rough peripheral ring-shaped edge 15.

The disc 12 is in turn provided on its inner face with an adherent and/or rough peripheral ring-shaped band 16, complementary and opposite to the peripheral ring-shaped edge 15 of the hole 14.

When the user exerts a pressure on the projection of the one-piece body 1, it makes the button 10 and, with it, the rod 11, the disc 12 and the centring portion 13 move towards the inside of said one-piece body 1. This centring portion is introduced in the hole 14 of the board 9 and guides the part 17 in its movement until the band 16 of the disc 12 is applied and firmly retained on the edge 15 of the hole 14, at which time the electronic warning unit 9 and therefore the warning device 20 are irreversibly started. From said time, it is impossible for the user to stop the operation of the mentioned warning device 20.

The inventor provides that a rigid base-support 5 is also embedded inside the one-piece body 1, which base-support is provided with a first cavity 6 intended to house the printed-circuit board 9*b*, as well as with a second cavity 7 for housing a battery 9*a* and a third cavity 8 for housing a device capable of generating signals perceivable by the user, preferably a vibrator 9*c*.

The rigid base-support 5 facilitates the overmoulding operation of the electronic warning unit 9 when the one-piece body 1 is shaped around said electronic warning unit 9, and especially protects the printed-circuit board 9*b* from overpressures which might damage the circuit image and its components. According to a preferred embodiment, this base-support 5 has a smooth, slightly arched lower face.

The printed-circuit board 9*b*, in a way known in itself, comprises a memory unit, an internal clock and a time counter, and has a pre-set alarm in its memory unit according to the hourly use required by the medicament for which it is intended to serve as a warning.

As regards the selection of the incorporated battery 9*a*, the latter must be chosen according to the following criteria: firstly, the duration of the battery 9*a*, once the electrical contact between the latter and the printed-circuit board 9*b* is established, it must always be greater than the necessary time passing between the total doses of the box of the associated medicament and secondly, the nature of the battery 9*a* must ensure a correct operation although a long time passes from when the warning device 20 leaves the factory until the warning device 20 is started, establishing contact between the battery 9*a*. To that end, the storage period of the battery 9*a* should be much greater than the time period which passes until the expiry of the associated medicament.

By way of example, if there is a box of medicaments containing 24 tablets which must be supplied to the individual at the rate of one tablet every eight hours for eight days, the electronic warning unit will generate, once activated, twenty-four warning signals at eight-hour intervals each. To ensure that the warning device 20 cannot be re-used, the electronic warning unit is suitable for generating a last signal in a continuous manner until the battery 9*a* is completely used up.

This last signal, as well as being more long-lasting than the rest of the preceding signals, can furthermore be clearly differentiated from the rest in intrinsic constitution or intensity. Upon noting this latter signal, the user knows that the treatment has ended and that he or she should have taken a specific number of doses, being able to check if the administration has been the correct one from the number of remaining doses.

It should be stated that the possibility is contemplated of the one-piece body 1 being provided with multiple additional devices, such as temperature sensor, a cardiovascular rhythm control sensor to warn of possible alterations thereof greater than certain upper and lower thresholds, a power-generating device through the movement of the user while he or she carries the warning device, etc.

The invention claimed is:

1. A warning device, provided with an electronic warning unit, powered by a battery and capable of generating warning signals at preprogrammed constant time intervals, wherein said electronic warning unit is embedded inside a body formed by a single piece of a moldable synthetic material; the electronic warning unit is provided with starting means for starting the warning device, which means can be actuated by application of a pressure on a part of an outer surface of the body; and the total number of signals is also preprogrammed, the electronic warning unit being suitable so that a last warning signal of the preprogrammed signals is differentiated in at least one of intrinsic constitution, intensity and duration from the preceding signals; wherein the starting means is configured such that, once actuated, irreversibly starts the warning device; and wherein the last warning signal lasts continuously until the battery is completely used up.

2. The warning device according to the claim 1, wherein the electronic warning unit comprises a printed-circuit board and originally there is no electrical communication between the battery and said printed-circuit board, the electronic warning unit being provided with starting means which can be actuated application of pressure on the part of the outer surface of the body, which starting means is configured for irreversibly establishing electrical communication between the battery and the printed-circuit board.

3. The warning device according to claim 1, wherein the electronic warning unit comprises a rigid base-support, embedded inside the one-piece body made of moldable synthetic material, provided with at least a first cavity configured to house a printed-circuit board, with a second cavity configured to house the battery and with a third cavity configured to house a vibrator device.

4. The warning device according to claim 1, wherein the one-piece body has a ring-shaped configuration.

5. The warning device according to claim 1, wherein an outer surface of the one-piece body comprises at least one of an indelible optical and tactile indication that informs the user of the preprogrammed time between at least one of every two consecutive warning signals and the total number of preprogrammed signals.

6. The warning device according to claim 1, wherein the single piece of a moldable synthetic material is a plastic or a silicone.

7. The warning device according to claim 1, wherein the electronic warning unit is embedded inside the body.

8. A warning device, comprising:

a body formed by a single piece of a moldable synthetic material;

an electronic warning unit powered by a battery and pre-programmed during manufacture to generate warning signals at predetermined constant time intervals; the electronic warning unit is embedded inside the body;

the electronic warning unit comprises an actuation mechanism that starts the warning device;

the total number of signals is pre-programmed during manufacture and a last one of the signals is differentiated in at least one of intrinsic constitution, intensity and duration from the preceding signals;

wherein the actuation mechanism is configured such that, once actuated, irreversibly starts the warning device; and wherein the electronic warning unit is configured to continuously generate the last signal until the battery is completely used up.

9. The warning device according to claim 8, wherein the actuation mechanism is actuated by pressure and, once actuated, irreversibly establishes an electrical connection to power the electronic warning unit.

10. The warning device according to the claim 9, wherein the electronic warning unit comprises a printed-circuit board and, prior to actuation of the actuation mechanism, there is no electrical connection between the battery and the printed-circuit board.

11. The warning device according to claim 8, wherein the electronic warning unit comprises a rigid base-support embedded inside the body, the rigid base-support comprising a first cavity that houses a printed-circuit board, a second cavity that houses the battery and a third cavity that houses a vibrator device.

12. The warning device according to claim 8, wherein the body is annular in overall shape.

13. The warning device according to claim 8, wherein an outer surface of the body comprises an indication that provides information about the pre-programmed warning signals.

14. The warning device according to claim 8, wherein the body is made of plastic or silicone.

15. The warning device according to claim 8, wherein the body is overmolded over the electronic warning unit so that the electronic warning unit is tamperproof.

* * * * *